United States Patent [19]

Häussler

[11] Patent Number: 4,676,140

[45] Date of Patent: Jun. 30, 1987

[54] HYDRAULIC CONTROL SYSTEM

[75] Inventor: Hubert Häussler, Neuheim/Zug, Switzerland

[73] Assignee: Beringer-Hydraulik GmbH, Neuheim/Zug, Switzerland

[21] Appl. No.: 775,440

[22] Filed: Sep. 12, 1985

[30] Foreign Application Priority Data

Sep. 15, 1984 [DE] Fed. Rep. of Germany ..... 3434014

[51] Int. Cl.[4] ..... F15B 11/08

[52] U.S. Cl. ..... 91/452; 91/454; 60/477; 187/17

[58] Field of Search ..... 91/451, 452, 454, 445, 91/448; 187/17, 28, 38, 68; 60/477, 452

[56] References Cited

U.S. PATENT DOCUMENTS

| | | | |
|---|---|---|---|
| 3,437,012 | 4/1969 | Bjorklund | 91/454 |
| 3,842,943 | 10/1974 | Nakamura et al. | 91/454 |
| 4,179,889 | 12/1979 | Gondek | 91/454 |
| 4,401,009 | 8/1983 | Zeuner | 91/454 |
| 4,548,296 | 10/1985 | Hasegawa | 91/452 |

FOREIGN PATENT DOCUMENTS 2139119 2/1973 Fed. Rep. of Germany .

*Primary Examiner*—James C. Yeung

[57] ABSTRACT

A hydraulic control system for an elevator or other similar reciprocating user is disclosed, which comprises an adjustable throttle valve and a control or bypass valve disposed in the fluid supply line between the pump and elevator. A pressure difference balance is provided for controlling the operation of the control valve, and the pressure difference balance has one end operatively connected to the pressure provided by the pump, and the other end operatively connected to the pressure in the user or load line. The control valve is thus adapted to maintain a desired pressure difference across the throttle valve which is independent of the load on the user. In addition, the zero setting of the pressure difference balance is adjustable, so as to permit the system to be equally operable in both the upward and downward movements of the elevator.

21 Claims, 2 Drawing Figures

HYDRAULIC CONTROL SYSTEM

Figure 1:
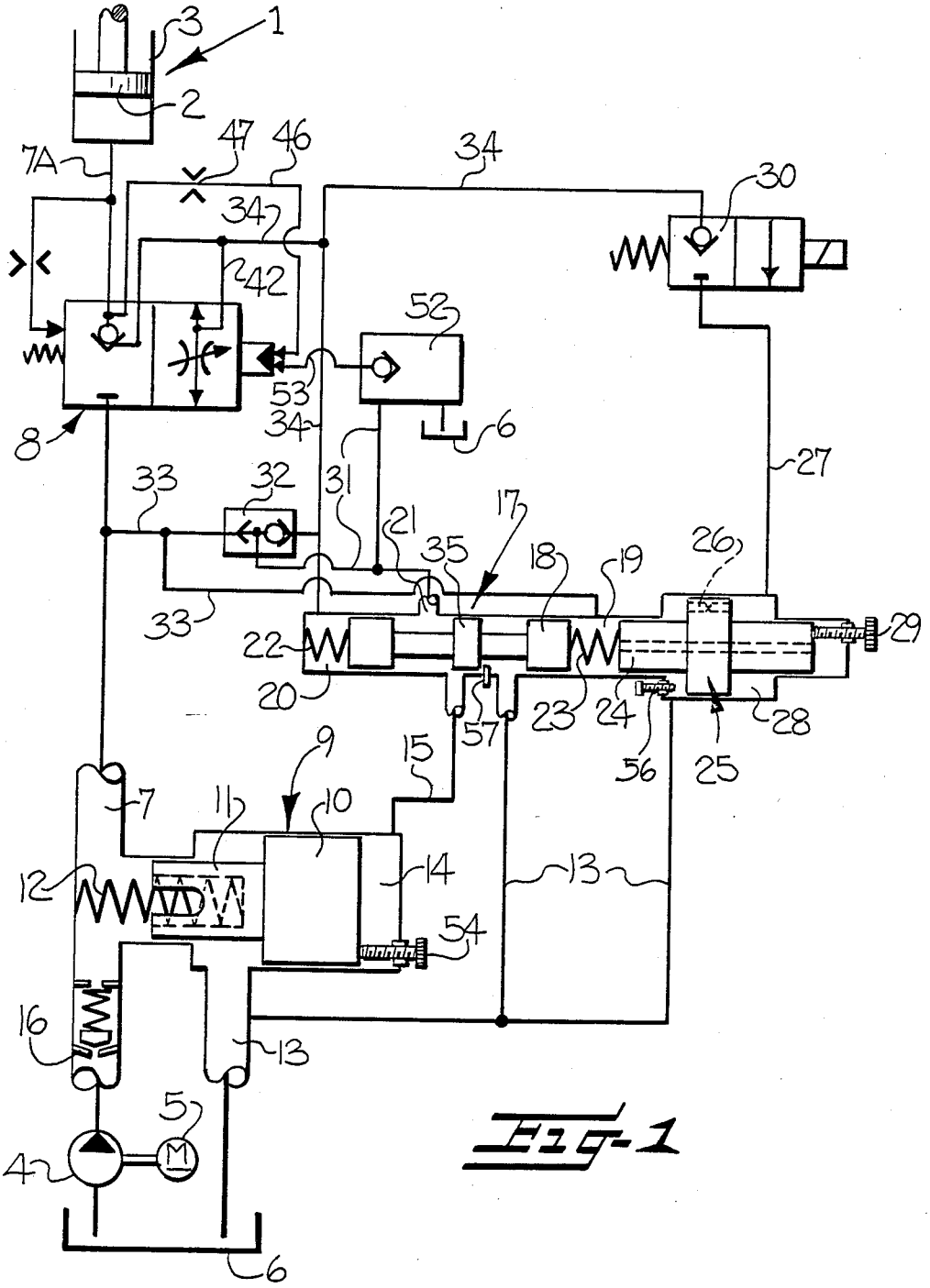

The present invention relates to a hydraulic control system adapted to control hydraulically operated elevators and other users.

Hydraulic control systems are known which include a metering or throttle valve positioned in the fluid supply line leading to a user, and a pressure difference balance adapted to monitor the difference in pressure on opposite sides of the throttle valve and to generate a hydraulic control pressure as a function of the pressure difference. The pressure difference balance comprises a piston which is biased at one end by the pressure upstream of the throttle valve, and which is biased at the other end by the pressure downstream of the valve. The system also includes a flow control valve which is positioned in the hydraulic supply line between the pump and the throttle valve, and which is controlled by the control pressure generated by the pressure difference balance to control the fluid pressure in the supply line upstream of the throttle valve. A system of this general type is further described in German OS No. 21 39 119.

In the above control system, the flow control valve includes a control chamber which receives the fluid from the supply line via a throttle, and which is connected via the control edge of the pressure difference balance to a storage tank. As a result, there is a continuous flow of fluid through the control chamber and to the storage tank, even in the static condition of the system. Thus the system is subject to fluid loss.

The above system is unsuitable for hydraulic control systems which are connected to an intermittently operating pump. This applies primarily to hydraulically operated elevators, in which the pump operates only during upward movement and the pump is inoperative during downward movement. The hydraulic control system serves the purpose of imparting a defined speed to the elevator descending under its own weight, through a corresponding control of the fluid (i.e. oil) flowing out of the elevator cylinder. Also, very low "creeping speeds" are desirable upon the approach of the predetermined end positions. However, this is not possible since the fluid is lost from the control chamber, causing the adjusted creeping speed to increase, which is undesirable.

In accordance with the present invention, the above disadvantages are avoided by providing the pressure difference balance with a double edge control which permits the control chamber of a control valve to be connected either to a reference input line, or to a return flow line. In the disclosed embodiment, the fluid flows only during a hydraulic adjustment of the control valve, and this flow is insignificant with regard to its power loss and its fluid consumption. In the static operation of the control valve, no fluid flows into or out of the control chamber.

When using a hydraulic control system in accordance with the present invention, and in particular in association with hydraulically operated elevators, the control valve is preferably designed as a bypass valve. To control the pressure in the supply line at the adjustable throttle, the control valve connects the supply line with a return flow line leading to a storage tank. The valve includes a regulating piston which is biased on one side by the supply pressure and a spring, and on its other side by the control pressure from the pressure difference balance. When used for this purpose, an advantage of the control valve resides in the fact that it is suitable for both the upward and downward operations, without any further adjustment.

As one aspect of the present invention, the pressure difference balance is connected to a reference input line. The pressure in this reference input line is converted to a control pressure as a function of the pressure difference which is present on the balance piston. The reference input line may be connected with the supply line between the pump and the adjustable throttle valve, or to the user or load line, i.e. between the throttle valve and the user. In one embodiment, which is adapted for use in association with reciprocatory users, in particular elevators, the reference input line of the pressure difference balance is connected via a two-way valve with either the user line downstream of the throttle valve, or with the supply line upstream of the throttle valve. As a result, it is provided that the higher pressure is always available for the control of the control valve. This feature is of particular importance when the elevator is at a standstill or during a slow descent, and the supply line between the control valve and the adjustable throttle valve is substantially at zero pressure. In this event, such low pressure would not be adequate to operate the control valve.

When used with reciprocating users, and in particular elevators, the present invention further provides that the balance piston of the pressure difference balance may be mounted with an adjustable spring tension and so that the zero position of the balance piston may be adjusted. Zero position is here defined as the position the balance piston assumes when neither of its ends is biased by fluid pressure. The spring tension may be adjusted so that the balance piston connects the output control line leading to the control valve with the reference input line in one zero position, and overlaps or slightly connects the output control line with the return flow line leading to the tank in the other zero position. Thus, during upward operation, the control valve may be biased by the reference pressure so as to close the bypass and build up a pressure in the supply line, until the pressure has overcome the initial force of the spring and the load pressure acting on the balance piston. The balance piston then moves to close the output control line to the reference input line, or if necessary, to open the control line to the return flow line. In the downward operation, the load pressure in the user line is initially greater than the pressure in the supply line. As a result, the load pressure displaces the balance piston against the initial force of the opposite spring, and the output control line is thereby connected with the reference input line, which tends to close the control valve and increase the pressure in the supply line. As the pressure increases in the supply line, it becomes operative to act against the load pressure so that the balance piston closes the control line to the reference input line and possibly opens the control line to the tank, so that the control valve is again actuated in the sense of bypassing fluid to the tank and lowering the pressure in the supply line.

A stop may be provided for limiting the movement of the balance piston, and in particular, for allowing a throttled opening between the reference input line and the control line. As a result, a dampening of the movement of the control valve may be provided.

The present invention also provides for the adjustability of the setting of the springs of the balance piston, which permits the hydraulic control system to be operative with the same structural units in both the upward and the downward directions. The setting of the springs is preferably adjusted as a function of the elevator control, and in a preferred embodiment, the end abutment for one of the springs is mounted for movement between two positions. Preferably, the movable end abutment is in the form of a hydraulically operated piston, which is hydraulically adjustable by the elevator control as a function of the operating direction.

A special advantage of the present invention resides in the fact that the limits of the adjustable movement of the abutment piston may be adjusted in each direction by adjustable mechanical stops. This arrangement permits a very accurate adjustment of the two zero positions of the piston and of the operative spring forces. Thus the pressure ratio of the throttle valve which is regulated by the pressure difference balance may be adjusted independently of each other for both the upward movement and the downward movement of the elevator.

When used in an elevator control, the throttle valve may also be hydraulically controlled, in that it may be biased in one direction by the supply pressure upstream of the valve, and in the other direction by a controllable counterpressure. To enable a low counterpressure, and to ensure an automatic adjustment of the throttle valve even at a high supply pressure, the throttle valve may be designed to include a differential metering piston, with the small piston end being biased by the supply pressure and the large piston end being biased by the controllable counterpressure.

In a preferred embodiment, the counterpressure for the metering piston of the throttle valve is provided by the load pressure, via the previously mentioned two-way valve. In particular, the small end of the metering piston is provided with an annular groove immediately upstream of its seat, and the groove is connected to the two-way valve via a pilot duct in the piston and a second annular groove on the piston. This design of the metering piston provides that the load pressure is applied to the counterpressure side of the piston in the direction of closing, and to the balance piston of the pressure difference balance in the sense of closing the control valve, before the metering piston has opened to connect the supply line and the user line. Thus a pressure corresponding to the pressure in the user line may build up before communication is effected between the supply line and the user line.

The connection between the counterpressure chamber of the throttle valve and the two-way valve includes an inlet throttle. Further, the counterpressure chamber is connected via a discharge throttle and stop valve with the storage tank. By opening the stop valve, and by reason of the predetermined ratio between the inlet throttle and the discharge throttle, the metering piston may be hydraulically actuated.

A further aspect of the hydraulic control system of the present invention resides in the fact that the pressure difference balance may be adjusted to a certain pressure difference between the user line and the supply line. As a result, the behavior of the user in operation substantially depends on the movement of the metering piston. This movement is predetermined by the inlet throttle and the discharge throttle, so that a load independent behavior in operation, together with uniform acceleration and deceleration, may be achieved.

Some of the objects and advantages of the present invention having been stated, others will appear as the description proceeds, when taken in conjunction with the accompanying drawings, in which—

Figure 2:
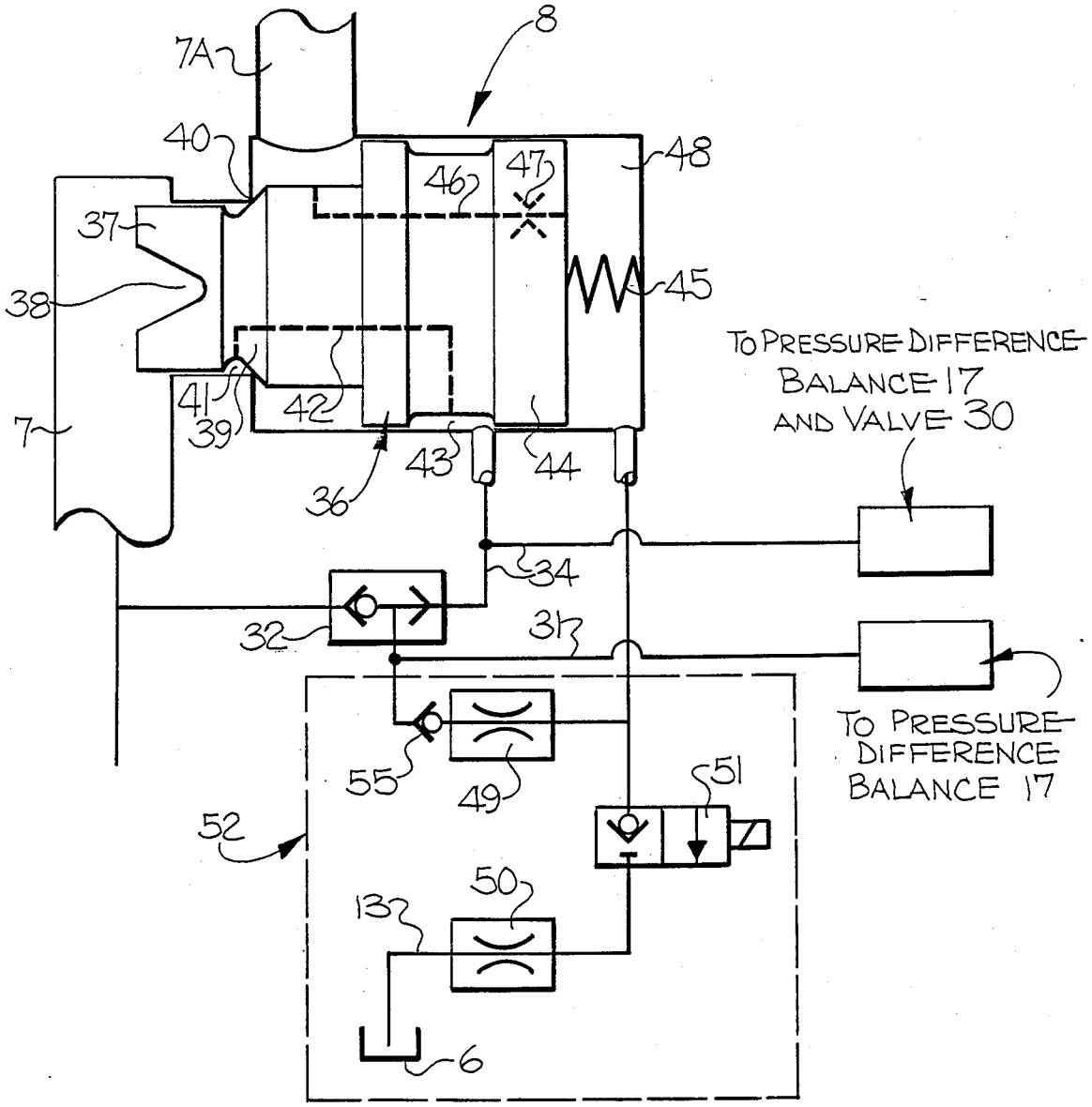

FIG. 1 is a schematic diagram of a hydraulic control system which embodies the features of the present invention; and FIG. 2 is a more detailed view of a portion of the circuit shown in FIG. 1.

Referring more specifically to the drawings, FIG. 1 illustrates a hydraulic control system in accordance with the present invention and which is adapted to operate a user 1, such as an elevator, which comprises a cylinder 3 and a piston 2. A hydraulic pump 4 is powered by a motor 5, and the hydraulic fluid (oil) is delivered from the storage tank 6 and pumped into the supply line 7. From the supply line 7, the fluid passes through an adjustable throttle valve 8, and then to a user line 7A which is operatively connected to the user 1. The throttle valve 8 thus is positioned to adjust the flow from the pump 4 to the user 1. A control valve 9 is disposed in the supply line 7 between the pump 4 and the throttle valve 8, for selectively bypassing a portion of the fluid in the supply line 7 to a return flow line 13 leading to the tank 6.

The control valve 9 includes a cylindrical housing having an inlet opening communicating with the supply line 7 and an outlet opening communicating with the return flow line 13. A regulating piston 10 is slideably mounted in the housing for movement between a closed position closing communication between the inlet opening and outlet opening, and an open position which permits communication therebetween. The forward portion of the piston includes an extension 11 of reduced diameter, which has a transverse groove which provides the connection between the supply line 7 and return flow line 13. The forward extension 11 is biased toward the open position by a spring 12 as well as the pressure in the supply line 7. The larger portion of the piston 10 is biased by the pressure in a control chamber 14 formed at the inner end of the valve housing, and if desired, an automatic pressure relief device (not shown) may be provided in the control chamber 14. Such a pressure relief device is particularly desirable when the motor 5 has a Y-delta electrical circuit, and which starts on the Y circuit.

The supply line 7 further includes a one-way valve 16, which closes when the pump 4 is idle, i.e. when the elevator is idle or moves in a downward direction.

The pressure in the control chamber 14 is controlled via an output control line 15 leading from a pressure difference balance 17. The balance 17 includes a balance piston 18, which is slideably mounted in a tubular cylinder between springs 22 and 23. Also, the cylinder communicates with a reference input line 31, the return flow line 13, and the output control line 15. In operation, the balance 17 acts to selectively connect the reference input line or the return flow line to the output control line 15, in response to the pressure difference on opposite sides of the throttle valve 8. The abutment for the spring 23 is in the form of a forward end portion 24 of an abutment piston 25, and pressure may be applied to the opposite side of the piston 25 in the adjusting pressure chamber 28, via the adjustment line 27 and valve 30. The pressure in the chamber 28 is relieved via a throttle passage 26 which extends through the piston. The chamber formed on the forward side of the piston 25 is connected via the return flow line 13 to the tank 6. One end position of the piston 25 is determined by the adjustable set screw 29, and the other end position is determined by the set screw 56.

The ends of the balance piston 18 define hydraulic control chambers, 19 and 20, with the end chamber 19 receiving the pressure in the supply line 7 via the pilot duct 33, and with the load pressure end chamber 20 being biased, via the user pressure line 34, by the load or consumer pressure. Thus the balance piston performs a control motion as a function of the ratio of the load pressure and supply line pressure, wherein the control shoulder 35 of the piston cooperates with the outlet to the control line 15, the outlet 21 to the reference input line 31, and the outlet to the return flow line 13. The reference input line 31 is connected to a two-way valve 32, which in turn is connected to the pilot line 33 of the supply line 7, and to the user pressure line 34. The respectively higher pressure of these two lines is supplied via the reference input line 31 to the pressure difference balance as the input pressure thereto.

Referring now to the throttle valve 8, reference is made to FIG. 2. The throttle valve 8 has an inlet communicating with the supply line 7 and defining an annular seat 40, and an outlet communicating with the user line 7A. A metering piston 36 is slideably mounted in the housing, and the piston 36 includes a smaller forward cylindrical extension 37 having a transverse control groove 38 through which a connection is made between the supply line 7 and the user line 7A. The forward extension 37 further includes an annular shoulder 39 which is adapted to seat against the valve seat 40. This seating engagement permits the piston 36 to close the user line 7A to the supply line 7 without substantial leakage, which is particularly important in the idle condition, so as to prevent an unintended descent of the user, i.e. the cage of the elevator. The forward extension 37 of the piston further includes an annular groove 41 which is adjacent the shoulder 39, and which is connected via the pilot duct 42 in the piston with an annular groove 43 at the larger end 44 of the piston 36. The annular groove 43 is enclosed by suitable dynamic seals, and is connected with the user pressure line 34 which leads on the one hand to the two-way valve 32, and on the other hand to the pressure difference balance 17 and adjusting valve 30. The particular placement of the annular groove 41 on the piston 36 provides that the load pressure in the user line 7A is delivered via the duct system 42, 34 to the pressure difference balance 17 immediately after the metering piston has lifted from the seat 40.

The rear end of the metering piston 36 includes a relatively large shoulder 44, which is biased by a spring 45, and the metering piston further includes a connecting duct 46 which passes through the piston and communicates with the chamber 48 at the inner end of the valve housing. The connecting duct 46 includes a throttle 47, so as to pressurize the chamber 48 of the valve 8 with the user line pressure, when the valve is seated against the seat 40. This provides that the piston is held against its seat, free from leakage, during idle or whenever the pump is shut down.

The hydraulic control of the metering piston 36 includes a pressure converter generally indicated at 52, and as best seen in FIG. 2. The pressure converter 52 includes an inlet throttle 49, a discharge throttle 50, a one-way valve 55, and a seat valve 51, which permits passage to the return flow line 13 via the discharge throttle 50. The control line 53 from the throttle valve is connected via the inlet throttle 49 to the reference input line 31, and via seat valve 51 and discharge throttle 50 with the tank 6. The inlet throttle 49 and the discharge throttle 50 may be adjusted to a constant oil flow, and they are therefore preferably constructed as adjustable flow control regulators. Upon the adjustment of the flow ratio, the control pressure in the chamber 48 is dependent on the pressure in the reference input line 31, and in this regard, it will be understood that the throttle 47 in the metering piston 36 is very small in comparison to the throttle 49.

The operation of the illustrated hydraulic control system will now be described. During idle conditions, the motor 5 and the pump 4 are inoperative, the user 1, i.e. the elevator cage, exerts a pressure in the user line 7A, which is applied via the duct 46 and throttle 47, to the control chamber 48 adjacent the large end of the metering piston 36. As a result, the shoulder 39 is held against the seat 40, and the user line 7A is closed to the supply line 7, substantially free of leakage. Also, the supply line 7 is substantially at zero pressure, as is the annular duct 41 in the metering piston 36. The one-way valve 55 in the pressure converter 52 prevents the oil from returning from the control chamber 48 via line 53 into the control system. For this reason, the control chamber 14 of the control valve 9 is also at zero pressure. The piston 10 thus serves to open the supply line 7 to the return flow line 13, by reason of the force of the spring 12.

To initiate upward movement, the motor 5 and pump 4 are put into operation, and the valve 51 is switched. The valve 30 remains in the indicated position. In this regard, further non-illustarted connecting possibilities for the control of the startup acceleration and for the control of the creeping speed upon approaching a stopped position, are possible. Also not considered is the possibility of a pressure relief in the control chamber 14 when the motor 5 is initially started with a Y-connection.

Since the user pressure line 34 and the supply pressure pilot line 33 are initially at zero pressure, the control chamber 14 also is under no pressure. The spring 12 pushes the piston 10 against the stop screw 54, which is adjusted so that the oil flow is throttled and a pressure of about 3–6 bar develops in the supply line 7. This supply pressure is applied via pilot line 33 to the balance piston 18 on the supply pressure end 19. Similarly, the supply pressure reaches the two-way valve 32 and the reference input line 31, and the pressure converter 52. Also, the supply pressure passes through the converter 52 to the line 53 and the control chamber 48 of the throttle valve 8. In this regard, the inlet throttle 49 and the discharge throttle 50 are adjusted so that the oil flow through the inlet throttle 49 is about half as much as the oil flow through discharge throttle 50. As a result, the metering piston 36 is relieved of pressure in the chamber 48, and it is moved to the right by the pressure in the supply line 7. As it does so, it displaces the oil from the chamber 48 via the discharge throttle 50.

Upon the metering piston 36 moving to the right and lifting from the seat 40, the annular duct 41 becomes connected with the user line 7A. The pressure of the load is therefore supplied, via the annular duct 41 and the pilot duct 42, into the annular groove 43. From the groove 43, the pressure is supplied through the user pressure line 34 to the two-way valve 32, and to the load pressure end 20 of the pressure difference balance 17.

Since the valve 30 remains closed, the abutment piston 25 rests against the set screw 29. The springs 22, 23 are so dimensioned that the tension of the spring 22 preponderates in this position, and is operative to move the balance piston 18 in the direction of the stop 57. Since the load pressure end 20 of the balance is simultaneously biased in the same direction, the balance piston is held against the stop 57. As a result, the outlet to the reference input line 31 communicates with the output control line 15, and the control chamber 14 of the flow control valve 9 is biased by the pressure in the reference line 31. This pressure is selected by the two-way valve 32 to be the higher of either the pressure in the supply line 7, or the pressure in the user line 7A.

The pressure in the chamber 14 causes the control piston 10 of the flow control valve to move to the left, as seen in FIG. 1, so that the supply line 7 is closed with respect to the return flow line 13. This permits the pressure in the line 7 to build up further. Since the pressure in the line 7 is also supplied to the balance piston on the supply pressure end 19 via the pilot line 33, the pressure counteracts spring tension 22 and the load pressure on the end 20, so that the output control line 15 is initially closed to the reference line connection 21, and then connected with the return flow line 13. As soon as the pressure gradient between the load pressure end 20 and the supply pressure end 19, and thus also the pressure gradient between the user line 7A and the supply line 7, becomes too large, i.e. greater than that provided by the spring tension which is operative in a direction toward the stop 57, the balance piston moves to the left and thus connects the control chamber 14 of the control valve 9 with the return flow line 13. This provides a larger discharge cross section between the line 7 and the return flow line 13, until the pressure gradient has regulated itself to the desired value. The pressure drop across the metering piston 36 remains constant during the upward movement, whereby the flow is determined only by the cross section of the opening of the metering piston, and is independent of the load pressure. The entire behavior of the movement is thus substantially determined by the motion of the metering piston 36. Since this motion is load independent, in that the inlet flow regulator 49 and the discharge flow regulator 50 ensure a constant oil flow, the piston 2 of the user 1 moves in a load independent manner with uniform acceleration and deceleration.

Upward movement of the user 1 is terminated by closing the valve 51. As previously indicated, means and circuits may be provided for producing a creeping movement before reaching the terminal position, which are not illustrated. After the valve 51 has been closed, the motor 5 is also disconnected after a certain delay. Thus all elements are in the idle position, as shown in the drawing. Specifically, the user line 7A is again closed in a leakproof manner by the shoulder 39 resting upon the seat 40, and the pressure of the user line again builds up in the control chamber 48. The one-way valve 55 prevents the oil from returning from the control chamber 48 into the precontrol portion of the circuit.

It should be noted that the pressure gradient between the supply line 7 and the user line 7A may be predetermined by the setting of the screw 29 of the abutment piston 25. This permits the flow of the throttle valve to vary by nearly a 1:2 ratio. As a result, one and the same embodiment of the throttle valve may be employed for a wide range of applications.

To initiate the lowering operation, the valves 30 and 51 are concurrently switched to the open position. The motor 5 and the pump 4 remain inoperative, and the one-way return valve 16 which connects the pump with the supply line 7 is closed in the direction toward the pump by the associated spring.

The opening of the valve 51 relieves the control chamber 48 of pressure, and the metering piston 36 moves under the pressure of the user line 7A, which is operative on the opposite annular surface of the piston 36, to the right as seen in FIG. 2. The piston 36 thus lifts from the seat 40, and the load pressure in the line 7A is supplied via the annular duct 41, pilot duct 42, annular groove 43 and user pressure line 34, to the two-way valve 32. The pressure moves through the valve 32 to the reference input line 31 and to the pressure converter 52. The line 31 leads to the outlet 21 of the pressure difference balance 17, and the pressure is also delivered via the line 34 to the valve 30 and to the load pressure end 20 of the pressure difference balance.

From the valve 30, the pressure is supplied to the pressure chamber 28 of the abutment piston 25, and the abutment piston is displaced to the left as seen in FIG. 1. As a result, the zero position of the balance piston 18 is displaced to the left until the abutment piston 25 engages the stop 56. The stop 56 is an adjustable set screw, so that the control shoulder 35 of the balance piston covers the output control line 15 in its zero position, or already opens the line 15 to the return flow line 13.

It should be particularly noted that the adjustment of the set screw 56 for the piston 25 provides for the pressure ratio across the metering valve to be adjusted during the downward movement, independently of that of the upward movement. As previously noted, the pressure ratio for the upward movement may be adjusted by the screw 29.

The supply pressure on the supply pressure end 19, as well as the tension of the spring 23, which is biased by the displacement of the piston 25, tend to move the balance piston to the left, as seen in FIG. 1. Acting in the opposite direction is the load pressure in the load pressure end 20, and the spring 22. During the lowering operation, the load pressure is higher than the supply pressure, and as a result, the balance piston is displaced to the right, as long as the metering piston 36 is closed. Thus the pressure in the reference line 31 reaches the output control line 15 and the control chamber 14 of the control valve, via the pressure difference balance. This acts to close the bypass from the supply line 7 to the return flow line 13, against the force of the spring 12. When the throttle valve 8 opens, a pressure builds in the supply line 7, and this increase in pressure causes the balance piston 18 to move to the left, so that the output control line 15 is first closed, and then opened to the return flow line 13 as the pressure builds further. Thus, the pressure in the control chamber 14 decreases. The pressure difference balance 17 thus regulates a constant drop in pressure across the throttle valve 8, and as a result the downward movement is only dependent on the cross section of the opening at the metering piston 36. This opening cross section is again determined by the adjustment of the inlet flow regulator 49 and the discharge flow regulator 50, and a load independent downward movement may thus be ensured.

In the drawings and specification, there has been set forth a preferred embodiment of the invention, and although specific terms are employed, they are used in a generic and descriptive sense only and not for purposes of limitation.

That which is claimed is:

1. A hydraulic control system for delivering a pressurized hydraulic fluid to a user (1) and comprising:

pump means (4,5) for supplying pressurized hydraulic fluid to a fluid supply line (7), a user line (7A) operatively connected to said user (1), adjustable throttle valve means (8) connected between said fluid supply line and said user line for controlling the flow of the hydraulic fluid from said pump means to said user, pressure difference balance means (17) including a reference input line (31), a return flow line (13), and an output control line (15), for selectively connecting said reference input line or said return flow line to said output control line in response to the pressure difference in said fluid supply line and said user line, and control valve means (9) disposed in said fluid supply line between said pump means and said throttle valve means and operatively connected to said output control line of said pressure difference balance means for selectively exhausting a portion of the fluid in said fluid supply line in response to the fluid pressure in said output control line.

2. The hydraulic control system as defined in claim 1 wherein said control valve means comprises a housing having an inlet opening communicating with said fluid supply line and an outlet opening communicating with said return flow line (13), a piston (10) slideably mounted in said housing for movement between a closed position closing communication between said inlet opening and said outlet opening, and an open position permitting communication therebetween, and a control chamber (14) in said housing on one side of said piston and operatively connected to said output control line (15) of said pressure difference balance means such that the pressure in said output control line acts to bias said piston into a position between said closed position and said open position.

3. The hydraulic control system as defined in claim 2 wherein said control valve means further comprises spring biasing means (12) mounted on the other side of said piston and such that said spring biasing means and the pressure of the fluid in said fluid supply line act to bias said piston toward said open position, and the pressure in said control chamber (14) acts to bias said piston toward said closed position.

4. The hydraulic control system as defined in claim 3 wherein said pressure difference balance means comprises a cylinder slideably mounting a balance piston (18) therein, and with said reference input line (31), said return flow line (13), and said output control line (15) each communicating with said cylinder.

5. The hydraulic control system as defined in claim 4 wherein said pressure differential balance means further comprises a line (33) connecting one end (19) of said cylinder to said fluid supply line for biasing said balance piston to a position so as to interconnect said output control line and said return flow line, and a user pressure line (34) connected to the opposite end (20) of said cylinder and adapted for biasing the balance piston to a position so as to interconnect said reference input line (31) and said output control line.

6. The hydraulic control system as defined in claim 5 wherein said control system further comprises two-way valve means (32) for connecting said reference input line (31) to either said fluid supply line (7) or said user pressure line (34) in accordance with which line is at the higher pressure.

7. The hydraulic control system as defined in claim 6 wherein said throttle valve means includes duct means (42) for selectively connecting said user line (7A) to said user pressure line (34).

8. The hydraulic control system as defined in claim 7 wherein said pressure difference balance means further comprises means for selectively positioning said balance piston at either a first zero position wherein the reference input line (31) communicates with said output control line (15), or at a second zero position wherein said output control line is either closed or in communication with said return flow line (13).

9. The hydraulic control system as defined in claim 8 wherein said means for selectively positioning said balance piston includes springs (22, 23) supporting said piston at respective ends of said cylinder, and means for selectively altering the tension of one of said springs.

10. The hydraulic control system as defined in claim 9 wherein said pressure difference balance means further includes a stop (57) for limiting movement of said balance piston in a direction toward said first zero position.

11. The hydraulic control system as defined in claim 10 wherein said means for selectively positioning said balance piston comprises an abutment piston (25) coaxially mounted in said cylinder adjacent one end of said balance piston, with a spring (23) interposed therebetween, and means (30) for selectively moving said abutment piston in a direction toward said balance piston and so as to move said balance piston toward said second zero position.

12. The hydraulic control system as defined in claim 11 wherein said means for selectively positioning said balance piston further comprises means (29,56) for accurately adjusting the end positions of the movement of said abutment piston.

13. The hydraulic control system as defined in claim 6 wherein said throttle valve means comprises a valve housing having an inlet communicating with said fluid supply line and defining an annular seat (40), an outlet communicating with said user line, and a metering piston (36) slideably mounted in said valve housing so as to selectively move axially into engagement with said seat to close communication between said inlet and said outlet.

14. The hydraulic control system as defined in claim 13 wherein said metering piston (36) comprises a cylindrical front extension (37) adapted to extend through said annular seat (40) in the closed position, and said front extension includes an annular groove (41) therein which is located on the supply side of said seat in the closed position, and wherein said throttle valve means further includes a pilot duct (42) extending through said metering piston to a rear annular groove (36) on said metering piston and then to said user pressure line (34).

15. The hydraulic control system as defined in claim 14 wherein said metering piston of said throttle valve means further includes a rear cylindrical shoulder (44) which is larger than said cylindrical front extension (37) to define a rear pressure chamber (48) between said rear shoulder and the end of said valve housing, and wherein a pilot duct (46) communicates between said user line and said rear pressure chamber (48), with said pilot duct (46) including a throttle (47).

16. The hydraulic control system as defined in claim 15 wherein said pilot duct (46) extends through said metering piston.

17. The hydraulic control system as defined in claim 15 wherein said throttle valve means further includes a line (53) communicating between said rear chamber (48) and said return flow line (13) via a control valve (51) and a flow regulator (50).

18. The hydraulic control system as defined in claim 17 wherein said line (53) further communicates with said reference input line (31) via a one-way valve (55) which precludes flow in a direction toward said line (31) and a second flow regulator (49) which permits a flow rate greater than that of said first mentioned flow regulator (50).

19. A hydraulic control system for delivering a pressurized hydraulic fluid to a user (1) and comprising:

pump means (4,5) for supplying pressurized hydraulic fluid to a fluid supply line (7), a user line (7A) operatively connected to said user (1), adjustable throttle valve means (8) connected between said fluid supply line and said user line for controlling the flow of the hydraulic fluid from said pump means to said user, pressure difference balance means (17) including a reference input line (31), a return flow line (13), and an output control line (15), for selectively connecting said reference input line or said return flow line to said output control line in response to the pressure difference in said fluid supply line and said user line, and wherein said return flow line is connected to a storage tank (6), with said storage tank being operatively connected to said pump means for supplying hydraulic fluid thereto, means (32, 42) for selectively connecting said reference input line to either said supply line or said user line, and control valve means (9) disposed in said fluid supply line between said pump means and said throttle valve means and operatively connected to said output control line of said pressure difference balance means for selectively exhausting a portion of the fluid in said fluid supply line in response to the fluid pressure in said output control line.

20. The hydraulic control system as defined in claim 19 wherein said control valve means includes an outlet communicating with said return flow line (13), such that the portion of the fluid which is exhausted from said fluid supply line passes into said return flow line passes into said return flow line and to said storage tank (6).

21. The hydraulic control system as defined in claim 20 wherein said pressure difference balance means comprises a cylinder slideably mounting a balance piston (18) therein, and means for selectively positioning said balance piston at either a first zero position wherein said reference input line (31) communicates with said output control line (15) or at a second zero position wherein said output control line is either closed or in communication with said return flow line (13).

* * * * *